US010633857B2

(12) United States Patent
Zanelli et al.

(10) Patent No.: US 10,633,857 B2
(45) Date of Patent: Apr. 28, 2020

(54) FLEXIBLE PANEL

(71) Applicant: POLITECNICO DI MILANO, Milan (IT)

(72) Inventors: Alessandra Zanelli, Modigliana (IT); Salvatore Viscuso, Milan (IT)

(73) Assignee: Politecnico Di Milano, Milan (IT)

( * ) Notice: Subject to any disclaimer, the term of this patent is extended or adjusted under 35 U.S.C. 154(b) by 269 days.

(21) Appl. No.: 15/566,032

(22) PCT Filed: Apr. 12, 2016

(86) PCT No.: PCT/IB2016/052069

§ 371 (c)(1),
(2) Date: Oct. 12, 2017

(87) PCT Pub. No.: WO2016/166658

PCT Pub. Date: Oct. 20, 2016

(65) Prior Publication Data

US 2018/0119420 A1 May 3, 2018

(30) Foreign Application Priority Data

Apr. 14, 2015 (IT) ..... BG2015A0020

(51) Int. Cl.
*E06B 9/08* (2006.01)
*E04B 2/86* (2006.01)
(Continued)

(52) U.S. Cl.
CPC ..... *E04B 2/8664* (2013.01); *E02D 29/0208* (2013.01); *E04B 1/166* (2013.01);
(Continued)

(58) Field of Classification Search
CPC ..... E04B 1/168; E04B 1/343; E04B 1/34336; E04B 1/34357; E04B 1/34373;
(Continued)

(56) References Cited

U.S. PATENT DOCUMENTS 2,101,836 A * 12/1937 Benedict ..... B63B 3/68 52/406.3
2,750,313 A * 6/1956 Schwartz ..... E04B 1/7654 52/406.3
(Continued)

FOREIGN PATENT DOCUMENTS

DE 199 18 248 A1 4/1999
DE 102013009519 A1 12/2014
(Continued)

OTHER PUBLICATIONS

International Search Report dated Jul. 5, 2016 issued in PCT Application No. PCT/IB2016/052069, filed Apr. 12, 2016.
(Continued)

*Primary Examiner* — Johnnie A. Shablack
(74) *Attorney, Agent, or Firm* — Workman Nydegger

(57) ABSTRACT

A flexible panel includes: a plurality of first blades made of semi-rigid material, of rectangular shape, having a pair of long sides and a pair of short sides; a pair of textile membranes which connect each pair of said first blades along said long sides; each of the plurality of first blades include at least one second blade, of quadrilateral shape, connected in a folding manner to one of the short sides, along a line of contact between one of the plurality of first blades and the at least one second blade; when the panel opens it creates vertical tubular hollow areas laterally delimited by the plurality of first blades and by the one pair of textile membranes which joins them.

10 Claims, 7 Drawing Sheets

(51) Int. Cl.
*E04B 1/16* (2006.01)
*E02D 29/02* (2006.01)
*E04B 2/74* (2006.01)

(52) U.S. Cl.
CPC ..... *E04B 1/168* (2013.01); *E04B 2/7405* (2013.01); *E06B 9/08* (2013.01)

(58) Field of Classification Search
CPC ..... E04B 1/34384; E04B 2/14; E04B 2/74; E04B 2/7401; E06B 9/06; E06B 2009/2625; E06B 2009/2627; E06B 3/94; E06B 3/805
See application file for complete search history.

(56) References Cited

U.S. PATENT DOCUMENTS 2,786,004 A * 3/1957 Schwartz ..... E04B 1/7654 52/406.3
3,039,670 A * 6/1962 Hardon ..... B65D 5/3678 206/521.8
3,112,532 A * 12/1963 Slowinski ..... E04B 2/7457 52/783.17
3,368,316 A * 2/1968 Crowder ..... A63H 33/088 52/592.1
3,531,851 A * 10/1970 Douglas ..... E04B 1/34378 29/434
3,555,751 A * 1/1971 Thorgusen ..... E02D 19/04 52/127.3
3,670,948 A * 6/1972 Berg ..... B65D 5/3678 229/117.06
3,749,636 A * 7/1973 Tranquillitsky ... B65D 19/0002 428/51
3,766,693 A * 10/1973 Richards, Jr. ..... E04B 1/34378 52/71
3,854,746 A * 12/1974 Flynn ..... B62B 13/16 280/19.1
3,975,882 A * 8/1976 Walter ..... E04C 2/40 52/571
3,977,119 A * 8/1976 Nelson ..... A63H 3/52 446/478
4,095,639 A * 6/1978 Ryan ..... A01G 9/225 160/84.02
4,122,638 A * 10/1978 O'Brian ..... E04H 1/12 217/14
4,254,574 A * 3/1981 Stock ..... A63H 33/044 446/128
4,294,875 A * 10/1981 Schramm ..... B31F 1/24 428/72
4,388,354 A * 6/1983 Suominen ..... A47H 23/00 160/84.01
4,865,889 A * 9/1989 Boyse ..... B32B 3/12 428/12
4,873,810 A * 10/1989 Lecaroz ..... E04B 1/3205 52/575
5,074,090 A * 12/1991 Hafers ..... B65D 81/3858 52/406.3
5,270,092 A * 12/1993 Griffith ..... B32B 3/12 428/69
5,270,095 A * 12/1993 Ito ..... B21D 47/00 428/116
5,768,851 A * 6/1998 Nagaoka ..... E04B 1/6158 52/309.11
6,068,039 A * 5/2000 Judkins ..... E06B 9/262 160/121.1
6,079,172 A * 6/2000 Chenel ..... A47F 5/106 52/238.1
6,630,222 B1 * 10/2003 Fay ..... E04B 1/99 160/348
6,767,615 B1 * 7/2004 Judkins ..... B31D 3/0215 156/290
6,863,949 B2 * 3/2005 Ehrmanntraut ..... B29C 63/04 428/69
7,051,489 B1 * 5/2006 Swiszcz ..... E04B 9/0442 160/84.05
7,134,250 B2 * 11/2006 Forrester ..... E04B 1/80 52/406.3
7,169,459 B2 * 1/2007 Lichodziejewski ..... B32B 3/20 428/188
7,194,846 B2 * 3/2007 Swiszcz ..... E04B 9/001 428/116
7,207,151 B2 * 4/2007 Swiszcz ..... E04B 9/001 428/116
7,377,084 B2 * 5/2008 Swiszcz ..... E04B 9/001 428/116
7,552,563 B2 * 6/2009 Becker ..... B42D 15/042 229/108
7,874,304 B2 * 1/2011 Ostrowski ..... E04B 1/34378 135/128
8,955,258 B2 * 2/2015 Jacques ..... E04H 3/22 52/2.18
8,959,865 B2 * 2/2015 Kratz ..... E04B 2/02 405/16
9,027,706 B2 * 5/2015 Staudt ..... E04B 1/84 181/295
9,290,935 B2 * 3/2016 MacAllen ..... A47C 4/04
9,463,915 B2 * 10/2016 McDonald ..... B65D 81/1075
9,689,161 B2 * 6/2017 MacAllen ..... A47C 4/04
9,797,134 B2 * 10/2017 MacAllen ..... A47C 4/04
9,896,835 B2 * 2/2018 Hauptman ..... E04B 1/32
10,011,981 B2 * 7/2018 Sica ..... E04C 2/386
2003/0019179 A1 * 1/2003 Colson ..... E04B 9/00 52/506.06
2006/0260270 A1 * 11/2006 Swiszcz ..... E04B 9/001 52/783.1
2011/0094554 A1 * 4/2011 Ostrowski ..... E04B 1/34378 135/128
2011/0146078 A1 * 6/2011 Hauptman ..... E04B 1/32 29/897.3
2012/0309258 A1 * 12/2012 Hawthorne ..... A63H 33/04 446/85
2013/0118092 A1 * 5/2013 Kramer ..... E04B 1/34326 52/23
2015/0121772 A1 * 5/2015 Berken ..... E04B 1/34331 52/28
2015/0322714 A1 * 11/2015 Rupel ..... E06B 9/262 160/84.05
2016/0318377 A1 * 11/2016 Patin ..... B60J 1/2091
2018/0119420 A1 * 5/2018 Zanelli ..... E04B 1/166
2018/0305920 A1 * 10/2018 Sica ..... E04C 2/386
2019/0003251 A1 * 1/2019 Amory ..... E06B 9/262
2019/0106883 A1 * 4/2019 Moore ..... E04B 9/0464
2020/0032580 A1 * 1/2020 Strand ..... E06B 9/36

FOREIGN PATENT DOCUMENTS

EP 0109108 A1 * 5/1984 ..... A01G 9/16
EP 0124157 A1 * 11/1984 ..... E04B 1/76
FR 18679 5/1914

OTHER PUBLICATIONS

Written Opinion dated Jul. 5, 2016 issued in PCT Application No. PCT/IB2016/052069, filed Apr. 12, 2016.
Italian Search Report dated Jan. 11, 2016, issued in Italian Application No. BG20150020, filed Apr. 14, 2015.

* cited by examiner

FLEXIBLE PANEL

BACKGROUND OF THE INVENTION

1. Field of the Invention

The present invention refers to a flexible panel, i.e., a panel used for the construction of prefabricated walls, dwellings and/or as thermal or acoustic insulation, and relative production method thereof.

2. Present State of the Art

In the event of a natural calamity it is often necessary to provide emergency dwellings.

Normally tents are used but they are not particularly robust and are normally inadequate when meteorological conditions are extreme.

Means exist to create more robust and more performing walls, such as metal structures covered by tarpaulins, prefabricated concrete structures and many others. These solutions, however, require many materials that have to be transported and long preparation and installation times.

SUMMARY OF THE INVENTION

The object of the present invention is to provide a flexible panel which is easy to produce.

A further object is to provide a flexible lightweight panel.

A further object is for it to be easily transportable.

A further object is for it to have minimum overall dimensions for transport.

It must also be easy to install.

It must also be possible to use materials available in situ.

According to the present invention, said objects and others are achieved by a flexible panel comprising: a plurality of first blades, made of semi-rigid material, of rectangular shape, having a pair of long sides and a pair of short sides; a pair of textile membranes which connect each pair of said first blades along said long sides; each of said plurality of first blades comprises at least one second blade, of quadrilateral shape, connected in a folding manner to one of said short sides, along a line of contact between one of said plurality of first blades and said at least one second blade; when said panel opens, it creates vertical tubular hollow areas delimited laterally by said plurality of first blades and by said one pair of textile membranes that joins them. Said objects are furthermore achieved by a method for the production of a flexible panel comprising the phases of joining a flexible membrane to each of the long lateral edges of a plurality of first rectangular semi-rigid blades; joining along a short side of each of said plurality of first rectangular semi-rigid blades at least one second blade, in a folding manner along a line of contact between said plurality of first blades and said at least one second blade, so as to create vertical tubular hollow areas delimited laterally by said plurality of first blades and by said one pair of textile membranes that joins them.

Further characteristics of the invention are described in the dependent claims.

This solution offers many advantages with respect to the solutions of the known art.

Thanks to the present invention a panel is obtained which can be compressed like a concertina during transport, i.e., when at rest, having negligible dimensions with respect to the dimensions when installed.

Also the weight is greatly reduced when at rest.

The manufacture is simple and can be carried out by a combination of existing technologies.

Once positioned in situ, even without fillings, it is self-supporting and therefore facilitates installation.

Thanks to its structure, it is possible to obtain not only straight panels but also curved panels and panels with 90° angles, without the use of additional structural elements.

Once the compartments, which form inside the panel when opened, are filled with various types of materials, easily found in situ, it becomes a stable wall to all intents and purposes.

The invention is designed for widespread use in the humanitarian sector, more precisely in the field of post-emergency housing reorganization.

It can also be applied as a permanent or temporary partition system in different fields of use: civil or military, outdoor or indoor, construction or furnishing.

The structure can be applied not only as a vertical wall but also as a horizontal or sub-horizontal surface for use as a ground insulating layer or as a cover.

The materials constituting the product (textile membranes and semi-rigid bars), the height of the panel and the dimension of the cells can vary according to the intended application.

BRIEF DESCRIPTION OF THE DRAWINGS

The characteristics and advantages of the present invention will become evident from the following detailed description of a practical embodiment thereof, illustrated by way of non-limiting example in the accompanying drawings, in which.

DETAILED DESCRIPTION OF THE PREFERED EMBODIMENTS

Figure 1:
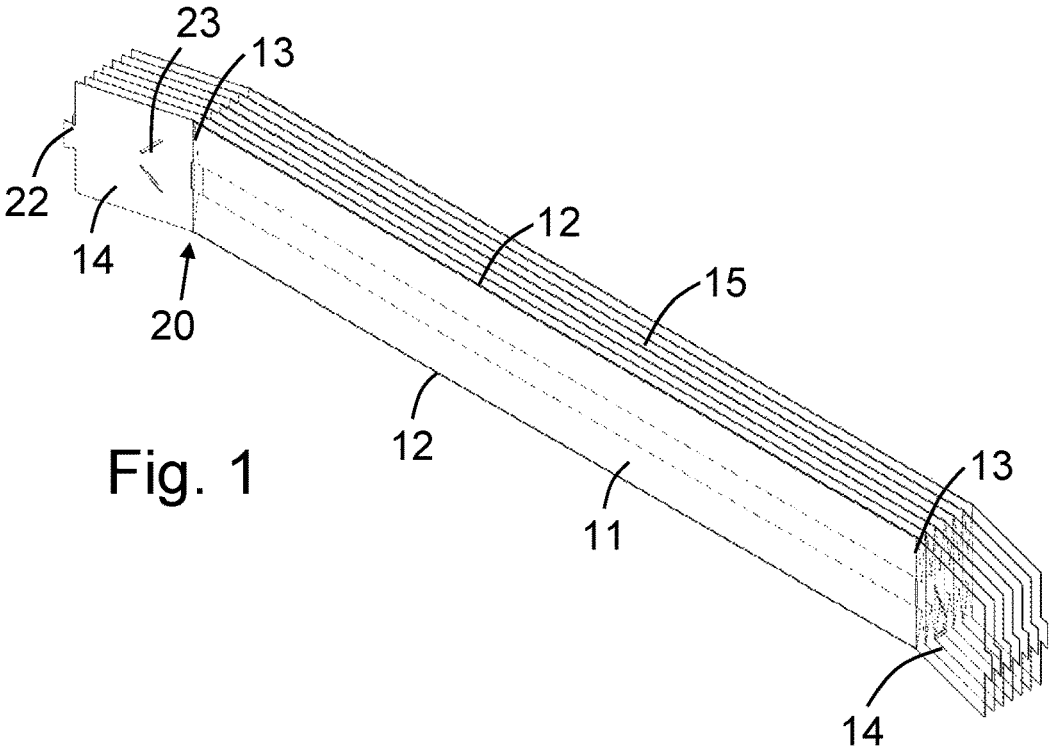
FIG. 1 shows a flexible panel, seen closed, according to the present invention.
Figure 2:
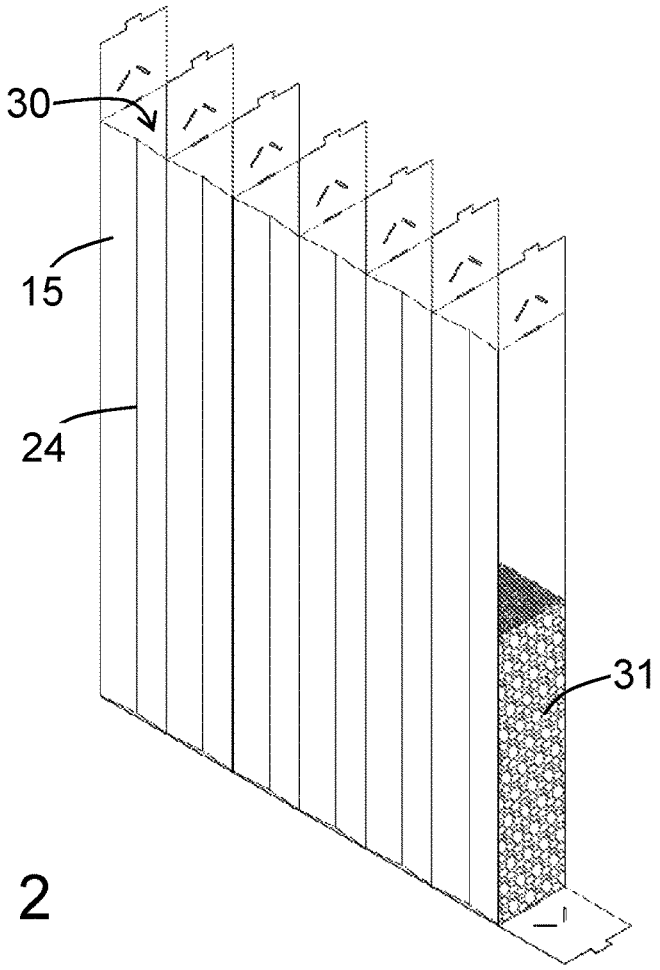
FIG. 2 shows a flexible panel, installed, with upper blades open according to the present invention.
Figure 3:
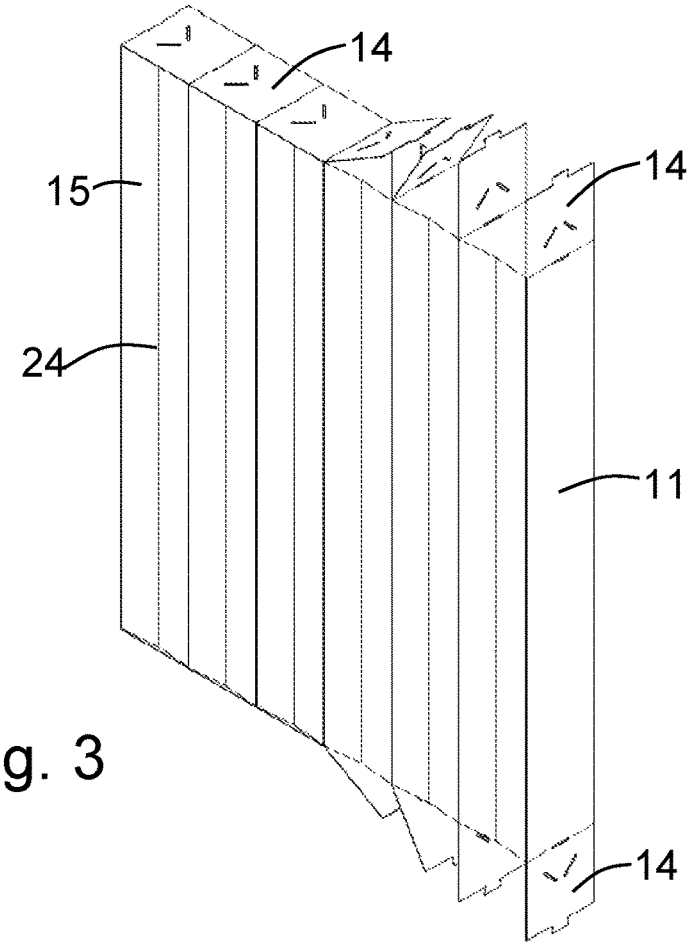
FIG. 3 shows a flexible panel, installed, with blades partially closed, according to the present invention.
Figure 4:
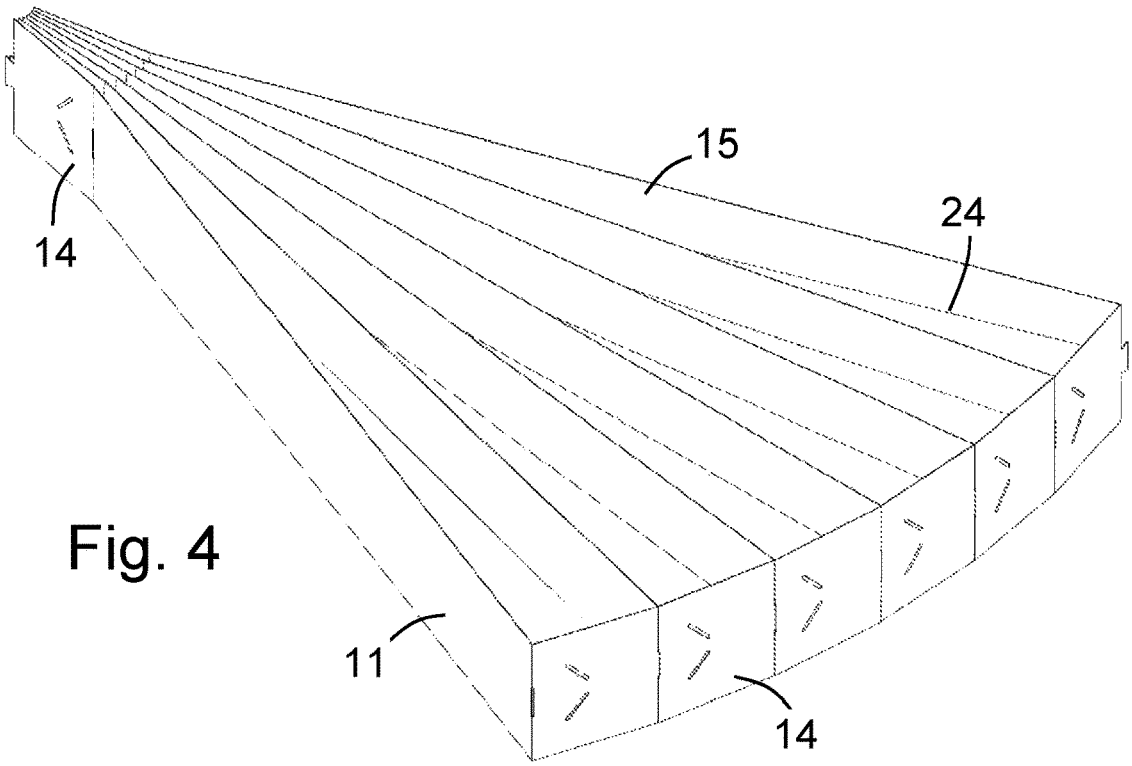
FIG. 4 shows a flexible panel, with upper blades closed and lower blades open, according to the present invention.
Figure 5A:
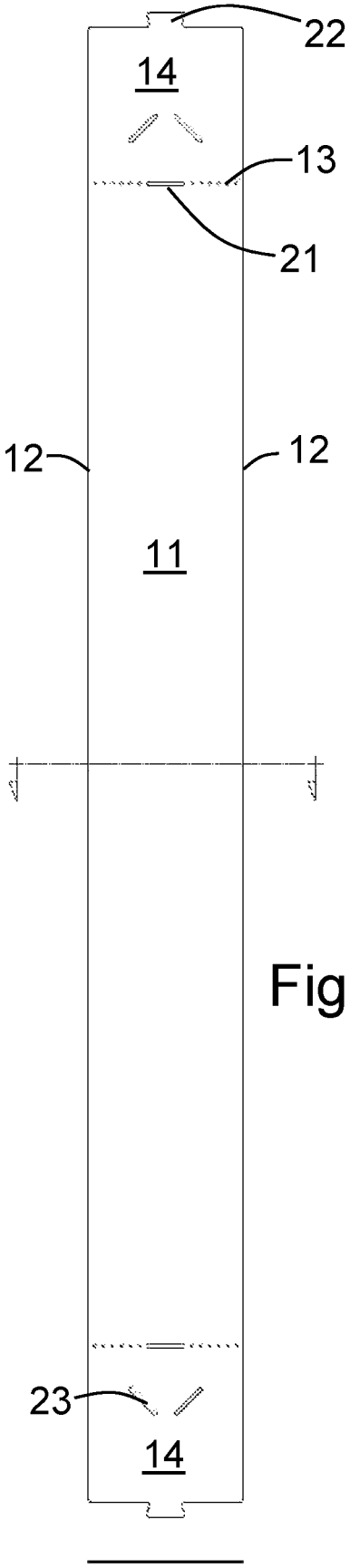
FIG. 5*a* shows a main blade of a flexible panel, from the front and in section, according to an embodiment of the present invention.
Figure 5B:
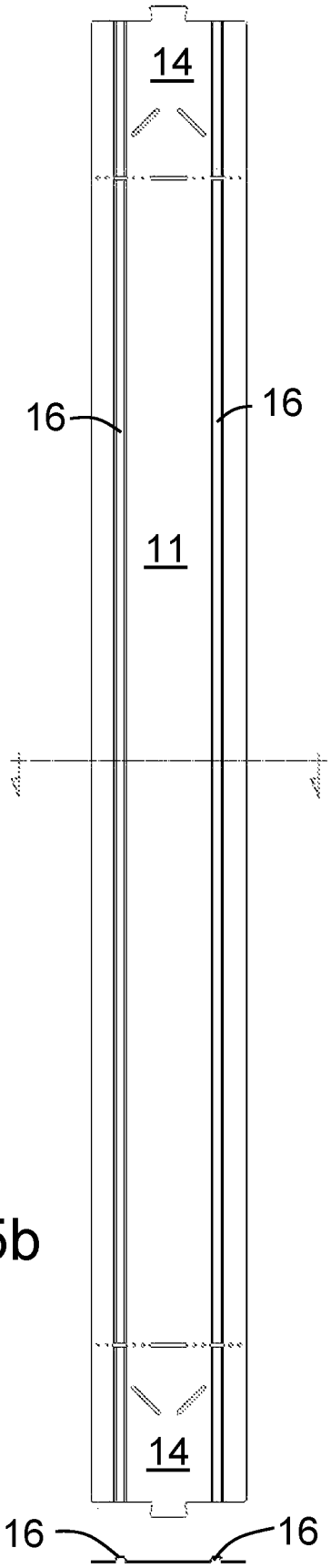
FIG. 5*b* shows a main blade of a flexible panel, from the front and in section, according to another embodiment of the present invention, with the insertion of ribs.
Figure 6A:
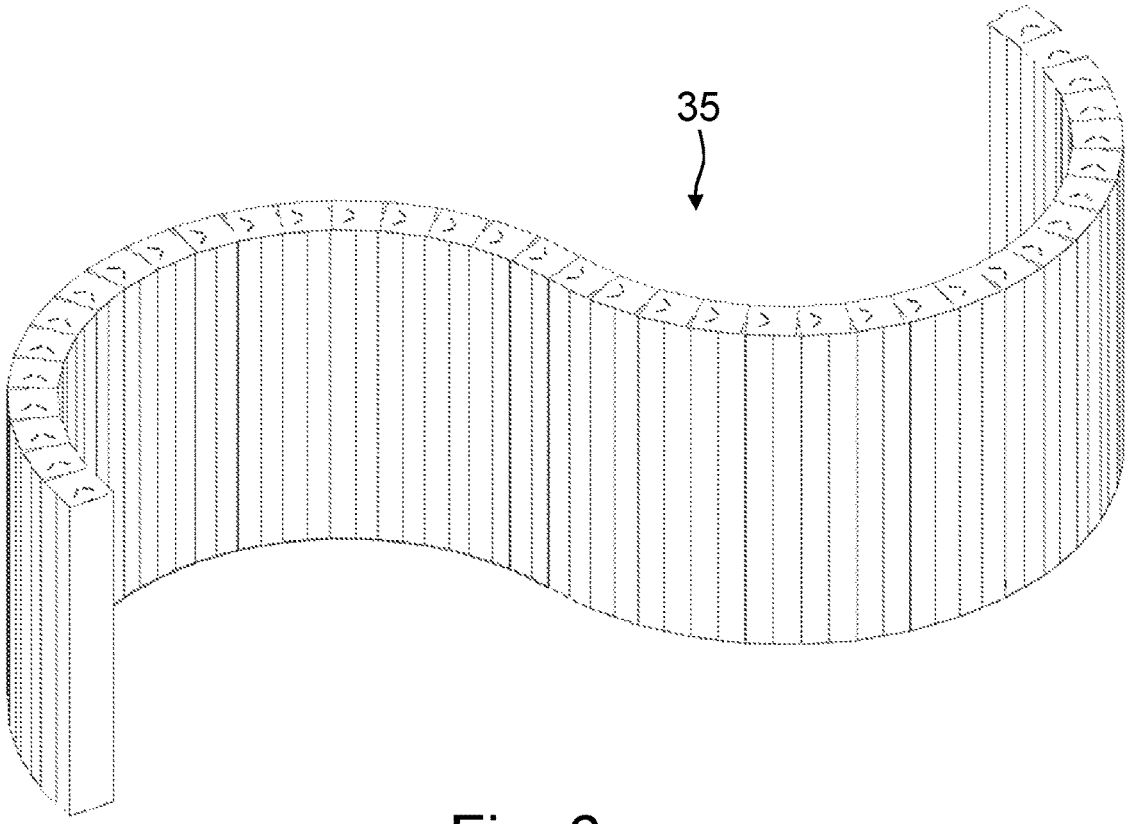
FIG. 6*a* shows a flexible panel, installed, which forms curves, according to the present invention.
Figure 6B:
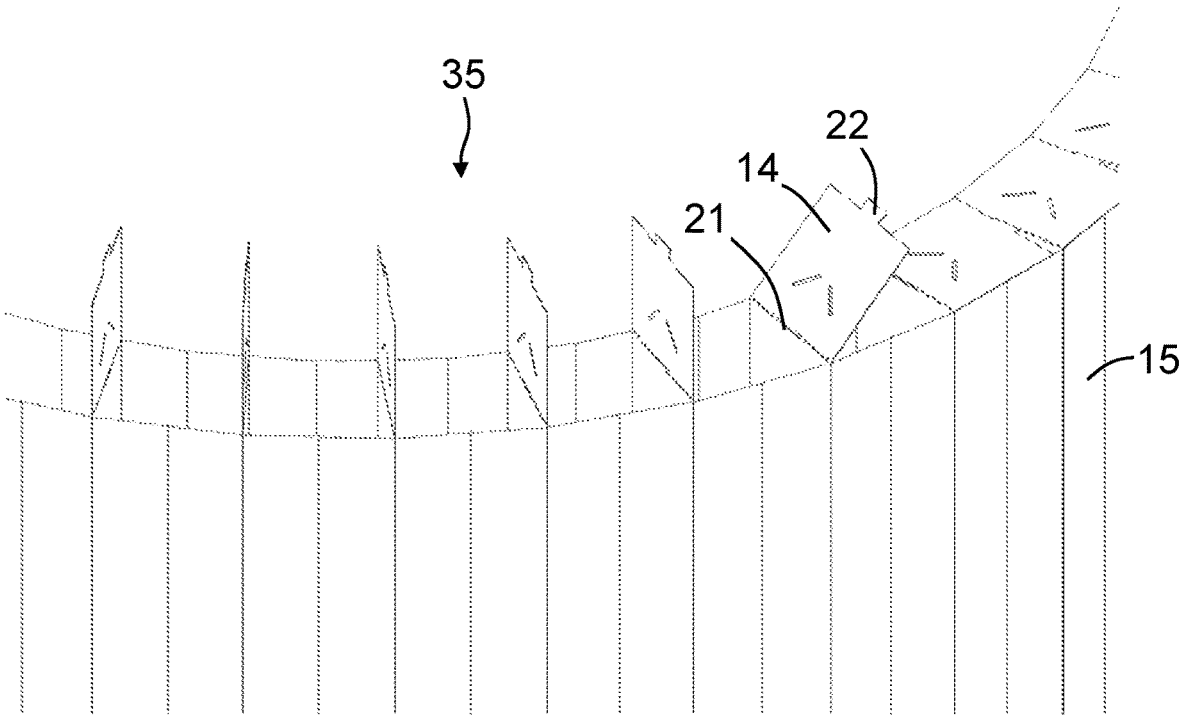
FIG. 6*b* shows an enlarged portion of a flexible panel, installed, which forms curves, according to FIG. 6*a* of the present invention.
Figure 7:
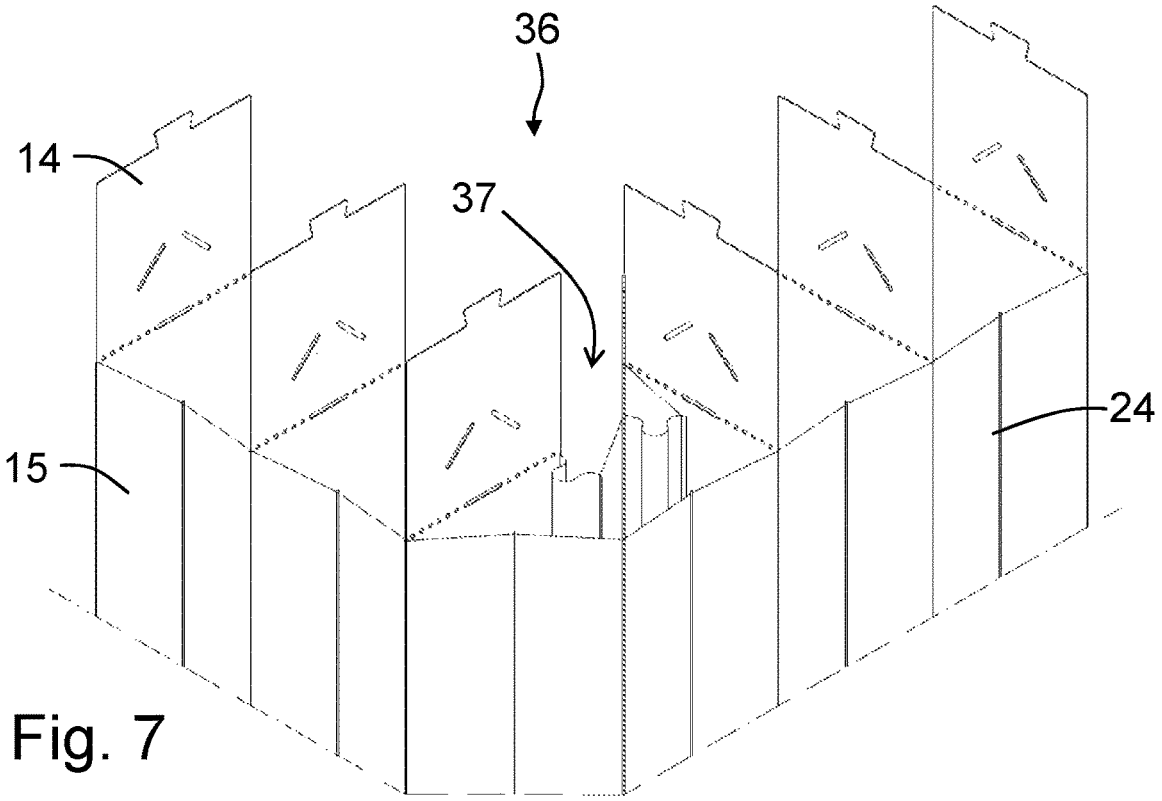
FIG. 7 shows a flexible panel, during the formation of a 90° angle, according to the present invention.
Figure 8:
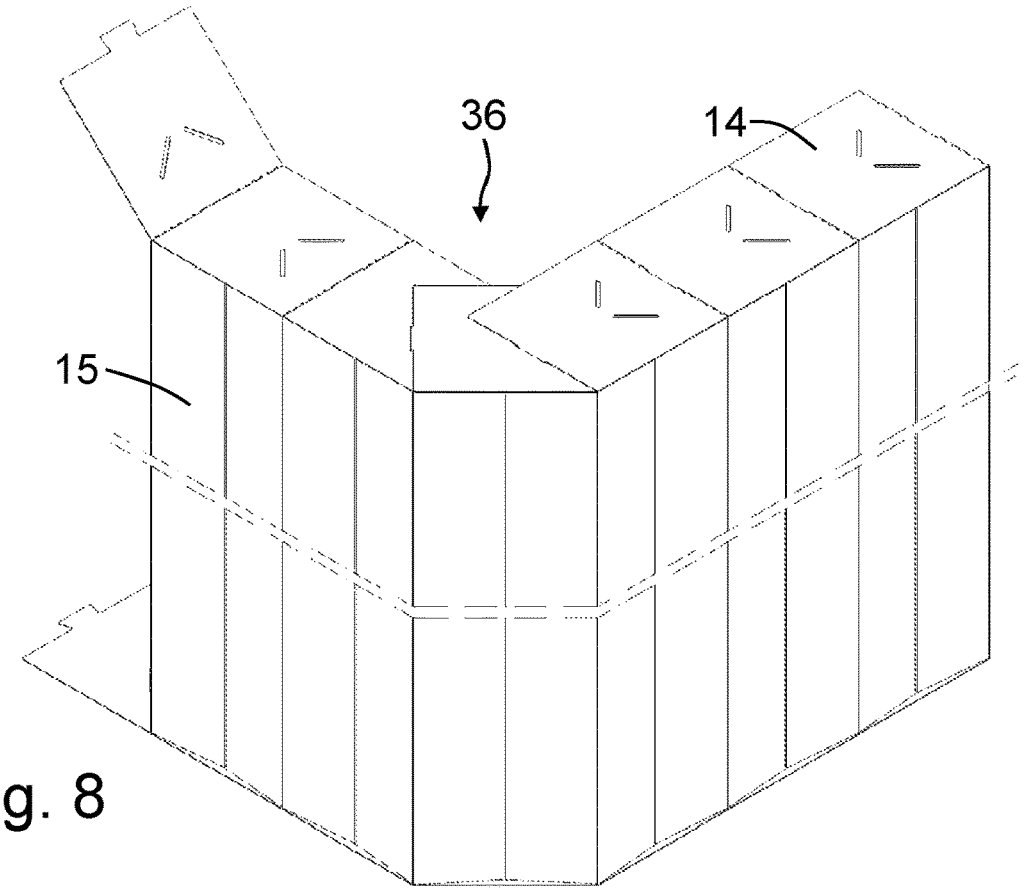
FIG. 8 shows a flexible panel, with a 90° angle, according to the present invention.
Figure 9:
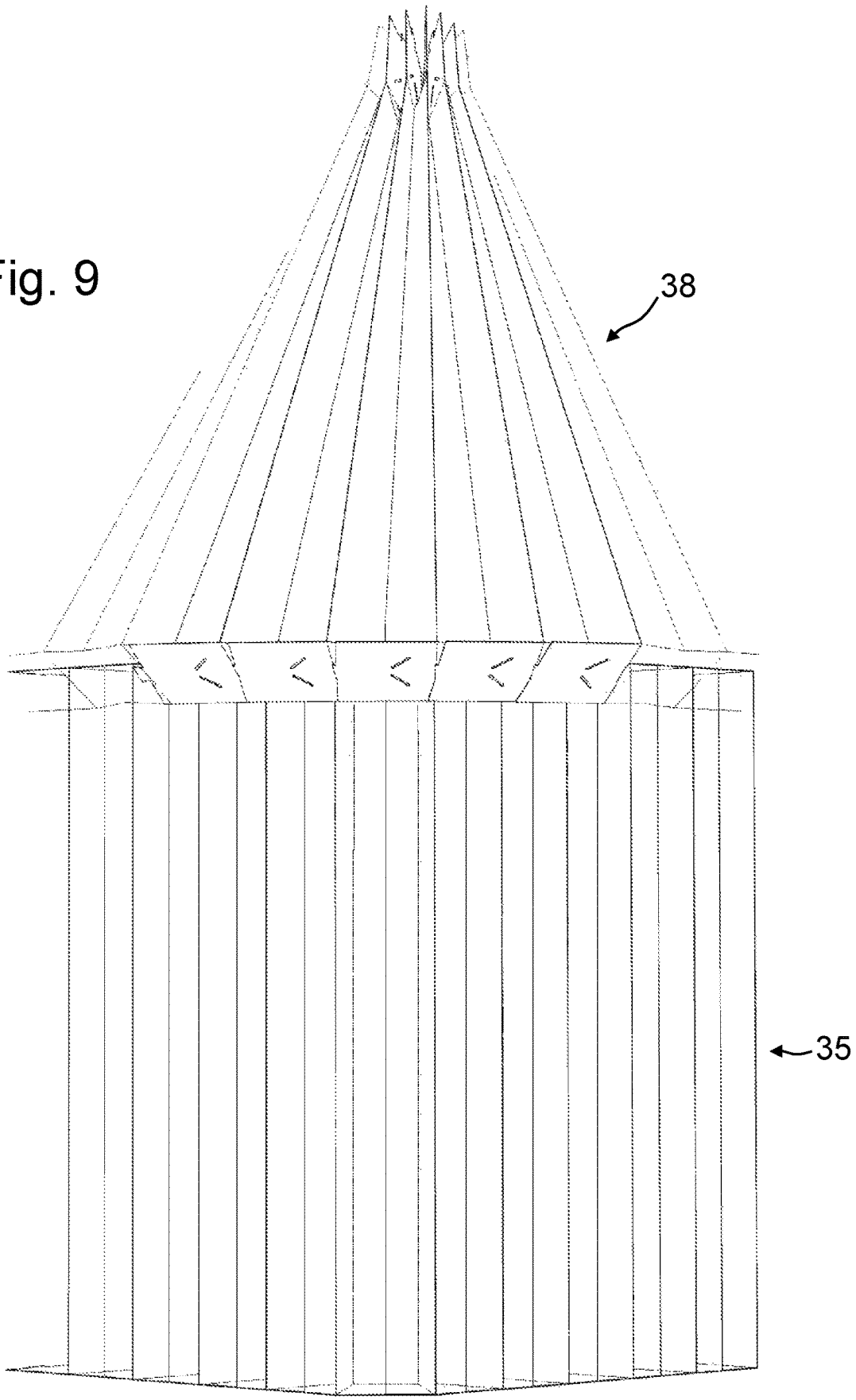
FIG. 9 shows a flexible panel, installed, as an inclined roof, according to the present invention.

Referring to the attached figures, a flexible panel, according to the present invention, comprises a plurality of first blades 11, made of semi-rigid or rigid material, with rectangular shape, having a pair of long sides 12 and a pair of short sides 13.

Each first blade 11 comprises a pair of second blades 14, with quadrilateral shape, connected in a folding manner to the short sides 13 of the first blades 11.

The second blades 14 are foldable in the sense that they can rotate with respect to the short sides 13 along the line of contact between the second blades 14 and the first blades 11.

Said panel furthermore comprises a flexible membrane 15 which connects each pair of first blades 11 along the long sides 12.

The first blades 11 and the second blades 14 are made, for example, of polyvinyl chloride (PVC) with thickness of 1-3 mm, and are cut, starting from square or rectangular sheets, using a numeric control plotter. With these thicknesses, semi-rigid structures are obtained which can be flexed but not bent.

To obtain completely rigid structures, thicker blades can be used, or alternatively rigid materials, for example metals or composites, or having a greater resistance to the peak loads applied to the short sides 13.

It is advantageous, however, to use materials with minimum thickness blades in order to reduce weight and overall dimensions.

The first blades 11 and the second blades 14 are flat, but to increase the rigidity, in an alternative embodiment, ribs 16 are provided, for example two longitudinal ribs having rectangular or trapezoidal section, obtained by means of thermoforming or pressing according to the material used.

Along the contact (and bending) line 20, between a short side 13 of the first blade 11 and the inner side of the second blade 14, a slit 21 is made, central to the short side 13, to close the second blade 14 and to facilitate bending of the second blade 14 along the bending line 20.

To facilitate bending, a plurality of slits or holes can also be provided as an alternative or in combination spaced from one another along the bending line 20.

Lightening of the bending line, by means of holes or slits, facilitates bending or, in other words, rotation of the second blade 14 around the joining line between the second blade 14 and the first blade 11.

The second blade 14 comprises, on the side opposite the line of contact 20 with the first blade 11, and centrally to it, a rectangular flap 22 which extends beyond the edge of the side of the second blade 14.

The second blade 14 further comprises a pair of incisions 23 distinct and angled 90° from each other. They are arranged substantially on the lines joining the vertex of the angles of the second blade 14, at the back of the short side 13, and the centre of the second blade 14.

The flap 22, of a second blade 14, is adapted to cooperate with the slit 21 of a second blade 14 adjacent to the previous one. By inserting the flap 22 into the slit 21, the second blade 14 can be closed in a horizontal position, in the case of straight panels.

The flap 22, of a second blade 14, is also adapted to cooperate with the pair of incisions 23, of a second blade 14 adjacent to the previous one, being inserted between them to block the second blade 14 on the adjacent one, in the case of curved panels.

Alternatively to the pair of incisions 23 it is possible to provide only one incision which describes an arc, to allow insertion of the flap 22 in the case of curvature of the panel.

According to the present invention the second blades 14 are also semi-rigid like the first blades 11, but in an alternative embodiment, the second blades 14 can be made of any material, also flexible (like the flexible membrane 15) glued to the first blades 11 along the line of contact 20.

The blades 14 can also be rectangular 40 and be longer than the short side 13. Furthermore, the flexible membrane 15, positioned between a first blade 11 and the adjacent one, can have several pre-folds 24, parallel to the long side 12 of the first blades 11, intermediate with respect to the two weldings on the edges of the long sides 12 of the first blades 11. The pre-folds 24 are provided to facilitate bending of the flexible membrane 15 towards the inside of the panel.

Figure 10:
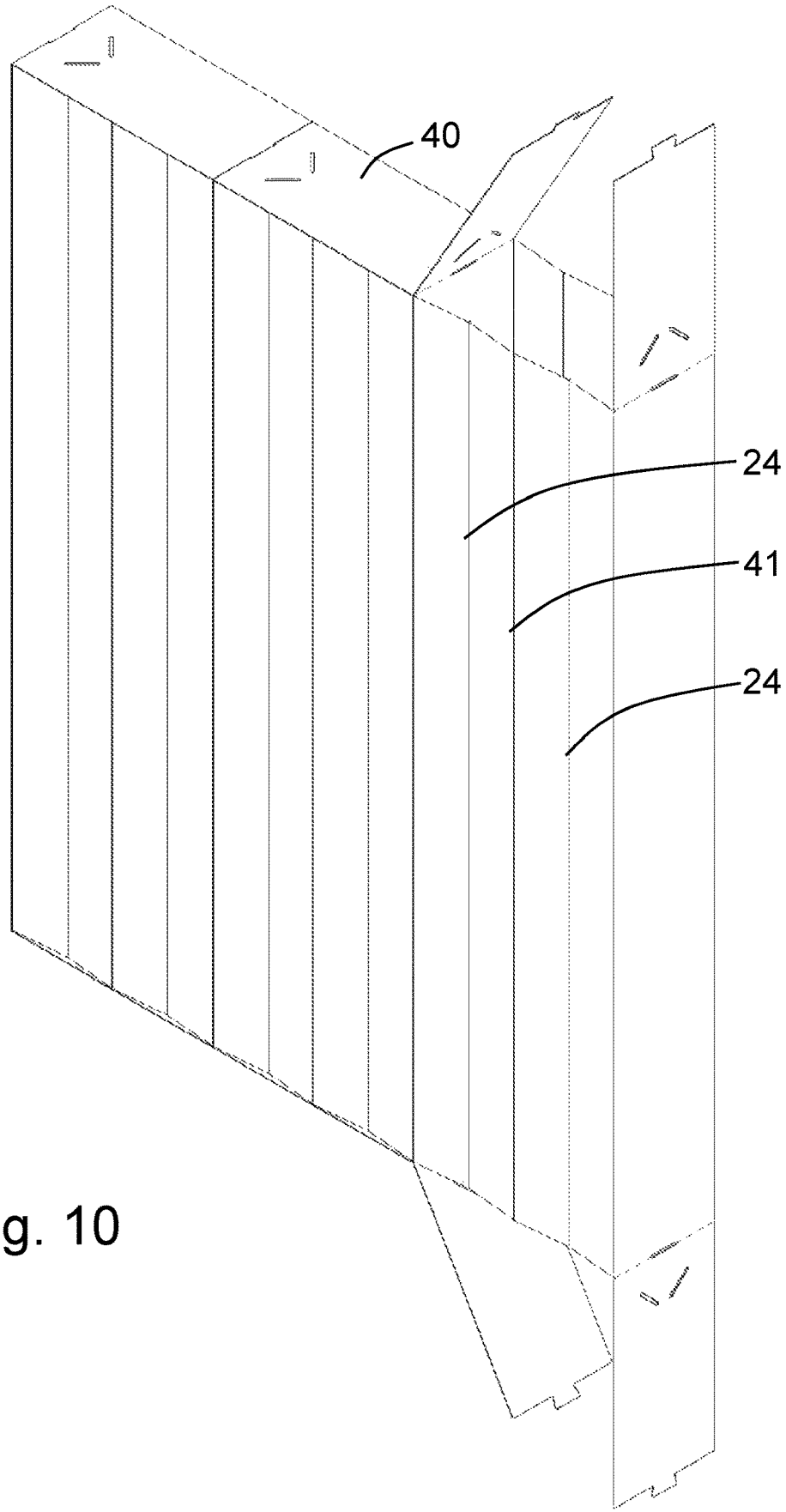
FIG. 10 shows a flexible panel, installed, with blades partially closed and flexible membranes of multiple length with respect to the length of the first blade 11, according to the present invention.

In an alternative embodiment (FIG. 10) between two first adjacent blades 11 there can be two lateral pre-folds 24 and a central pre-fold 41. The lateral pre-folds 24 ensure that the flexible membrane 15 bends easily towards the inside of the panel, and the central pre-fold 41 is provided to facilitate bending thereof towards the outside of the panel; thanks to the pre-folds 24, the flexible membrane 15, once folded, remains inside the panel between two first adjacent blades 11.

The flexible membrane 15 is made of a material like polyester coated with polyvinyl chloride (PES/PVC), for example, with a thickness of 0.1-1 mm, so as to obtain an impermeable membrane, sufficiently robust and flexible (soft, bendable, deformable).

The flexible membrane 15, which has a width equal to the length of the first blade 11, or a multiple of it, is welded, by means of ultrasound or high frequency or by heating, to the edges of the long sides 12 of the first blades 11, ensuring that the first blades 11 are spaced from one another by a pre-defined distance.

The pre-fold 24 is obtained via the use of automated fabric pleating machines and can be reinforced by a light welding, which facilitates bending in the required direction.

Said pre-fold 24 facilitates concertina folding of the panel, facilitates tensioning and allows curvature of the panel in an aesthetically pleasing manner; it also aids the flexible membrane 15 which can be used for curvature of the panel, avoiding puckering.

The dimensions of a panel in one of the possible embodiments according to the present invention are the following.

The first blade 11 and the second 14 blade are 250 mm wide, the first blade 11 is 2000 mm long, the slit 21 is 80 mm long, the flap 22 is 80 mm wide and 30 mm long, the incisions 23 are 30 mm long and 3 mm wide, and the length of the flexible membrane 15 between two first adjacent blades 11 is 250 mm.

The panel can have any length since it is possible to join any number of blades 11 with the flexible membrane 15.

In an alternative embodiment of the panel, instead of having two pairs of second blades 14, the panel comprises only one second blade 14, which can be closed, on one side, while the other side is closed by other closing means, for example a portion of flexible membrane like that of the sides 15, or can be left completely open.

The operation of the invention is obvious for a person skilled in the art from what has been described and in particular is the following.

The desired length of the panel is obtained by making it to size or cutting it from a longer panel. The incision can be made along the flexible membrane 15.

The panel, since it is a concertina panel thanks to the flexible membrane 15, is opened by extending the concertina.

The second blades 14 are closed on one side. Said side will become the lower one to be placed on the ground or on a surface provided. For said closing, the second blades 14 are folded along the folding line 20 and the flap 22, of a second blade 14, is inserted into the incisions 20 or 23 of the second adjacent blade 14, according to the linear or curvilinear configuration of the structure, to lock it in the closed position.

When the panel opens, it creates a plurality of vertical tubular hollow areas 30 laterally delimited by a pair of first adjacent blades 11 and by the flexible membrane 15 that joins them, and which can be closed above and below by means of the second blades 14.

Said areas 30 are now filled with any material 31 preferably found in situ, like earth, sand, stones, wood, sawdust and other. Said material gives the structure a weight and increases its carrying capacity already partially guaranteed by the first blades 11, which are sufficiently rigid.

The areas 30 are preferably filled to ⅔ of their height to give the structure greater stability, because if filled completely, they would make the wall unstable and it could collapse.

The flexible membrane 15 forms the sides of the panel and the blades 11 (and 14) form supports for the panel until the tubular areas 30 are filled with the material 31. The areas 30 can then be filled, partially or completely, with stabilising materials or even insulating material.

The second upper blades 14 are folded by closing all the tubular hollow areas 30, and locked in position by inserting the flaps 22 into the incisions 20 or 23.

Preferably all the second blades 14 are folded in the same direction.

The panel can be straight, curved 35 or even at right angles 36. Thanks to the presence of the flexible membrane 15 it is possible to curve the profile of the panel by playing on the flexibility of the flexible membrane 15 and on the pre-fold 24.

A curved profile 35 of the panel is allowed by the flexibility of the flexible membrane 15, which is tensioned on one side and bends on the other side; closing of the second blades 14 is possible due to the presence of the incision 21 in which the flap 22 can be inserted also in the presence of curves. Alternatively, by inserting the flap 22 into one of the incisions 23, a curvature of the panel is obtained with amplitude equal to the angle described by each of the incisions 23 with respect to the line of contact 20.

By inserting the flap 22 into one of the incisions 23, a curvature of the panel is obtained with amplitude equal to the angle described by each of the incisions 23 with respect to the line of contact 20.

By alternating the side of insertion of the flaps 22 into the incisions 23 in two adjacent blades 14, and repeating the procedure several times, a jagged profile of the panel is obtained.

To configure a profile 36 of the panel with a right angle, the incisions 23 must be perpendicular to each other. In an area 30, on one side the flexible membrane 15 is bent 37, while on the other side it is tensioned, obtaining a first angle of 45°. By repeating this operation for two adjacent areas 30, a right-angle panel 36 is obtained.

It is also possible to obtain tapered panels 38 for use as a roof for dwellings made of walls of curved panels with circular profile 35.

In another embodiment of the panel, the second lower blades 14, which will rest on the floor, can be widened laterally so that they protrude from the panel, on one side or on both sides, by a few centimetres (for example 2 to 15 cm), so that they can be easily fixed to the floor by means of screws, pegs or accumulation of inert material, like earth, sand or other.

Any materials and any dimensions can be used for the panel, according to requirements and the state of the art.

The panel conceived as above is subject to numerous modifications and variations, all falling within the scope of the inventive concept; furthermore, all the details can be replaced by technically equivalent elements.

The invention claimed is:

1. A flexible panel comprising:

a pair of flexible textile membranes comprising a first flexible textile membrane and a second flexible textile membrane;

a plurality of first blades made of semi-rigid material, of rectangular shape, having a pair of long sides and a pair of short sides, each pair of long sides comprising a first long side and an opposing second long side, the first long side of each of the plurality of first blades being connected to the first flexible textile membrane at spaced apart locations and the second long side of each of the plurality of first blades being connected to the second flexible textile membrane at spaced apart locations;

each first blade of said plurality of first blades comprising a pair of second blades, of quadrilateral shape, each second blade of the pair of second blades being connected to and folding with respect to a corresponding one of the pair of opposing short sides along a line of contact;

wherein a vertical tubular hollow area is laterally delimited by each adjacent pair of said plurality of first blades and by said pair of said flexible textile membranes.

2. The flexible panel according to claim 1, wherein at least one of the second blades has a width equal to a width of at least one of the short sides of said plurality of first blades; and a length equal to or greater than a length of each of said flexible textile membranes.

3. The flexible panel according to claim 1, wherein each of said plurality of first blades are joined to one another by said pair of flexible textile membranes, wherein each second blade can be folded so as to close one side of a tubular area delimited laterally by an adjacent pair of said plurality of first blades joined to each other by said pair of flexible textile membranes.

4. The flexible panel according to claim 1, wherein the plurality of first blades, said pair of flexible textile membranes and said pair of second blades for each of said plurality of first blades form a flexible panel which can be compressed like a concertina.

5. The flexible panel according to claim 1, wherein said pair of flexible textile membranes has a length equal to a length of said first blades.

6. The flexible panel according to claim 1, wherein each of said plurality of first blades comprises at least one longitudinal rib.

7. The flexible panel according to claim 1, wherein each of said second blades comprise at least one slit positioned substantially in the centre of said second blade, and further comprises a front flap adapted to cooperate with said at least one slit.

8. The flexible panel according to claim 7, wherein said at least one slit comprises two slits angled by 90° to each other.

9. A method for producing a flexible panel comprising:

joining a first flexible textile membrane to a first long lateral edge of each of a plurality of first rectangular semi-rigid blades; and joining a second flexible textile membrane to a second long lateral edge of each of the plurality of first rectangular semi-rigid blades;

a short side of each of said plurality of first rectangular semi-rigid blades being connected to a respective second blade, the second blades being foldable along a line of contact between said short side of the plurality of first blades and said respective second blade, so as to create vertical tubular hollow areas delimited laterally by adjacent pairs of said plurality of first blades and by said first and second flexible textile membranes which joins them.

10. A flexible panel comprising:

a plurality of first blades made of semi-rigid material and being laterally spaced apart, each of the plurality of first blades having a rectangular shape with a first long side and an opposing second long side that longitudinally extend between a pair of opposing short sides;

a pair of flexible textile membranes comprising a first flexible textile membrane and a second flexible textile membrane, the first flexible textile membrane extending between and being connected to the first long side of each of the plurality of first blades, the second flexible textile membrane extending between and being connected to the second long side of each of the plurality of first blades, the pair of flexible textile membranes being connected to the plurality of first blades such that for each adjacent pair of the plurality of first blades, a vertical tubular hollow area is laterally delimited by the adjacent pair of the first blades and the pair of flexible textile membranes;

each first blade of the plurality of first blades comprising a pair of second blades, of quadrilateral shape, each second blade of the pair of second blades being foldably connected to a corresponding one of the pair of opposing short sides along a line of contact.

* * * * *